US007994941B2

(12) United States Patent
Sorbier et al.

(10) Patent No.: US 7,994,941 B2
(45) Date of Patent: Aug. 9, 2011

(54) PROCESS AND SYSTEM FOR MANAGING AN INTERRUPTION OF A BROADCAST OF A SONOROUS MESSAGE IN AN AIRCRAFT

(75) Inventors: Boris Sorbier, Merville (FR); Pierre Campagne, Toulouse (FR); Baptiste Maylin, Toulouse (FR)

(73) Assignees: Airbus, Blagnac (FR); Airbus Operations SAS, Toulouse (FR)

( * ) Notice: Subject to any disclaimer, the term of this patent is extended or adjusted under 35 U.S.C. 154(b) by 270 days.

(21) Appl. No.: 12/145,849

(22) Filed: Jun. 25, 2008

(65) Prior Publication Data

US 2009/0015438 A1 Jan. 15, 2009

(30) Foreign Application Priority Data

Jun. 29, 2007 (FR) ..... 07 56179

(51) Int. Cl.
*G08B 23/00* (2006.01)

(52) U.S. Cl. ..... 340/963; 340/945; 340/968; 340/970; 701/301

(58) Field of Classification Search ..... 340/963, 340/945, 947, 949, 951–953, 959–962, 965–970; 455/512, 701; 704/267, 274; 701/300, 301
See application file for complete search history.

(56) References Cited

U.S. PATENT DOCUMENTS

| | | | | |
|---|---|---|---|---|
| 2,804,501 | A * | 8/1957 | Hart | 379/51 |
| 3,641,496 | A * | 2/1972 | Slavin | 704/274 |
| 4,423,290 | A | 12/1983 | Yoshida et al. | |
| 6,002,347 | A * | 12/1999 | Daly et al. | 340/963 |
| 2008/0153529 | A1 * | 6/2008 | O'Neill et al. | 455/512 |
| 2009/0015437 | A1 | 1/2009 | Campagne et al. | |

FOREIGN PATENT DOCUMENTS

| | | |
|---|---|---|
| EP | 0 895 602 | 2/1999 |
| WO | WO 97/40401 | 10/1997 |

* cited by examiner

*Primary Examiner* — Hung T. Nguyen
(74) *Attorney, Agent, or Firm* — Oblon, Spivak, McClelland, Maier & Neustadt, L.L.P.

(57) ABSTRACT

A method for managing an interruption of emission, in an aircraft, of an acoustic message including an information item about a state of part of the said aircraft and/or about its environment, wherein the acoustic message is structured into one or more successive acoustic fragments each representative of the information item, the method includes the steps of: delaying, starting from a given moment, the execution of a decision to interrupt the emission of the acoustic message until the end of emission of an acoustic fragment that is in the course of emission at the given moment; and executing the interruption decision.

10 Claims, 3 Drawing Sheets

PROCESS AND SYSTEM FOR MANAGING AN INTERRUPTION OF A BROADCAST OF A SONOROUS MESSAGE IN AN AIRCRAFT

BACKGROUND OF THE INVENTION

The present invention relates to a method and an associated system for managing an interruption of the emission of an acoustic message in an aircraft.

In an aircraft cockpit, different monitoring systems are in charge of emitting alert messages in case of detection of an abnormal situation.

Firstly, the flight alert system ("Flight Warning System" for FWS for flight alert system, "Flight Warning Computer" for flight alert computer or else "Flight Warning Application" for flight alert application) is an on-board system intended to forewarn the crew members of an abnormal situation concerning a monitored system of the airplane.

The monitored systems may include detectors or calculators relating, for example, to the engines, to the fuel tanks or to the landing gears.

The flight alert system also emits automatic altitude announcements when the airplane passes through certain altitudes.

Furthermore, other monitoring systems have the function of forewarning the crew of risks related to the environment of the aircraft.

This is the case of the systems known as TAWS ("Terrain Awareness and Warning System" or impact warning and alert system), GPWS ("Ground Proximity Warning System" or ground proximity warning device), TCAS ("Traffic Collision Avoidance System" or on-board anti-collision system, also known as ACAS), WxR ("Weather Radio" or weather radar) or PWS ("Predictive Windshear System", a shear prediction system).

It is possible to integrate several of the equipment items that monitor the environment of the aircraft in a single monitoring system, known, for example, as AESS ("Aircraft Environment Surveillance System" or aircraft environment monitoring system).

These different alert systems, whether their function is to monitor a system of the aircraft or of its environment, communicate with the pilot by alert messages, which may include texts on screens, the illumination of lamps and/or acoustic messages, which may include voice syntheses.

The solution adopted until now to manage alert messages involved preliminary classification of alert conditions into two categories: high-priority alert conditions and normal-priority alert conditions.

In the event of detection of a normal-priority alert condition by an alert system, the corresponding acoustic message is activated immediately, except if an acoustic message associated with a high-priority alert condition is in the course of emission.

When a normal-priority alert condition is detected while a high-priority acoustic message is in the course of emission, the acoustic message in the course of emission is continued until the end of detection of the corresponding alert condition or until the end of emission of the acoustic signal, in the case of a signal that can be stopped before the end of detection of the corresponding alert condition. The normal-priority acoustic message is then emitted if the associated alert condition is still in existence at that moment.

In the case of detection of a high-priority alert condition by an alert system, the corresponding acoustic message is activated immediately.

If a normal-priority acoustic message is already in the course of emission, the acoustic message in the course of emission is interrupted immediately and the new acoustic message is emitted.

This method has the disadvantage that it does not take into account the content of the message in the course of emission, and therefore it risks interrupting emission of this message without taking into account the intelligibility of this content by the pilot.

Document TSO-C151a ("Technical Standard Order") presents such a solution of the type used heretofore.

SUMMARY OF THE INVENTION

The solution proposed here is aimed at improving the management of interruptions of acoustic alert messages in the course of emission.

According to a first aspect, the invention proposes a method for managing an interruption of emission, in an aircraft, of an acoustic message comprising an information item about a state of part of the said aircraft and/or about its environment, the acoustic message being structured into one or more successive acoustic fragments each representative of the said information item, and the said method comprising the steps:

- of delaying, starting from a given moment, the execution of a decision to interrupt the emission of the acoustic message until the end of emission of the acoustic fragment that is in the course of emission at the said given moment, and
- of executing the said interruption decision.

An acoustic message to which the invention is applicable may be an alert or announcement message about one or more normal or abnormal situations. It contains an information item representative of the state of operation of part of the aircraft and/or of physical conditions related to the environment of the aircraft (external pressure, external temperature, wind speed, etc.). Such a message is often, albeit not necessarily, specified by aviation authorities. It may contain words in English or in another language, as well as sounds having significance for the crew members in accordance with a predefined convention. This acoustic message has an emission duration that can be on the order of a fraction of one second or of several seconds.

Such a message is emitted on command of an avionic system, such as an alert system. Depending on the circumstances, it may be emitted one single time or several successive times, with or without pauses between successive emissions.

The acoustic message is structured beforehand into one or more fragments, for example at least two fragments. These fragments are defined in such a way that, when a single fragment is heard, it permits a crew member to identify the acoustic message on the basis of a convention, such as a language convention.

Preferably the acoustic message comprises a voice synthesis, each fragment comprising at least one word.

If applicable, the method may comprise, prior to the delay step, a step of determination of the structure of the acoustic message in order to identify the fragment or fragments of which it is composed.

This determination, for example, may be accomplished from a data table in which the fragmentary structures of different messages are stored in memory.

In general, the decision to interrupt emission of the acoustic message may be made at the initiative of an avionic system or of a human operator.

The given moment at which the delay step is undertaken may be the moment at which the interruption decision is made or a later moment.

By virtue of the structure of the acoustic message as fragments each representative of the information item about a state of part of the aircraft and/or about its environment or representative of at least a significant part of this information item, the management method makes it possible to be certain that the emission of the acoustic message is not interrupted before the end of full emission of at least a significant part of the information item, thus facilitating interpretation thereof by the crew members.

The fact that the emission of the fragment in progress is allowed to continue permits the pilot in particular or crew members to understand at least a sufficiently representative part of the message and therefore to obtain knowledge of the real physical conditions (airplane, environment) that led to emission of the message.

According to a particularly advantageous characteristic, the said acoustic message being a first acoustic message, and the decision to interrupt the said first acoustic message being made as a function of reception of an information item defining an alert condition, the method additionally comprises, after the step of execution of the said interruption decision, a step of activation of emission of an acoustic message corresponding to the alert condition. It is made clear that the first acoustic message may be a message corresponding to a previously detected alert condition.

Thus the second acoustic message is emitted after the fragment of the first acoustic message in the course of emission at a given moment, such as the moment at which the interruption decision was made, has been emitted completely.

That makes it possible to interrupt the first acoustic message in such a way that the second acoustic message can be emitted as soon as possible, while assuring that the information item of the first message has been emitted sufficiently that the pilot can understand it.

In effect, as has been seen, the first message can inform the pilot about the state or states of operation or about the conditions of use of part of the aircraft (monitoring system, internal equipment, external component such as an engine, a flap, landing gear, etc.), while the second message may be about another part of the aircraft.

The pilot may interpret the beginning of the second message as supplementing the beginning of the first. Thus the pilot wrongly risks believing that an alert signal is applicable to one part of the aircraft while he is actually applying it to a completely different part.

The method makes it possible to avoid this situation and thus reinforces the reliability of emissions of acoustic messages, and it effectively and reliably manages the interruption of a first acoustic message while conserving acceptable latency times as regards the emission of a second acoustic message, delayed by the first acoustic message in the course of emission.

Furthermore, the decision to interrupt the first message may be made as a function of comparison, with a current priority threshold associated with the acoustic message in the course of emission, of a priority attribute associated with the information item defining a second alert condition.

The current priority threshold associated with an alert in progress may be a priority attribute associated with the alert condition that led to activation of the alert, if applicable modified by other information items about the aircraft or its environment, which may be transmitted in real time.

If, by virtue of comparison means, it is observed that a detected alert condition has precedence over an acoustic message in the course of emission, the decision to interrupt the said acoustic message is made. If, on the contrary, it is observed that the acoustic message in the course of emission has precedence over the detected alert condition, the acoustic message in the course of emission is not interrupted.

Preferably, the said step of delay of execution of the interruption decision being a first delay step, the method additionally comprises a second delay step between the step of execution of the interruption decision and the step of activation of emission of a second acoustic message.

This delay step is a step of delay of activation of emission of a second acoustic message.

This second delay step permits the crew members to distinguish even more clearly, without any risk of confusion, the end of the first message and the beginning of the new message, and thus be able to correctly interpret the two transmitted alert messages.

Thus it reinforces the efficacy of management of interruptions of acoustic messages while conserving the reliability of these messages.

Preferably the duration of the second delay step ranges between 400 and 600 ms and is advantageously equal to 500 ms.

This duration is counted, for example, starting from execution of the interruption decision.

This duration makes it possible to ensure a good compromise between, on the one hand, the need to minimize the delay between detection of the second alert condition and emission of the second acoustic alert and, on the other hand, the need to maximize the separation of the two acoustic messages. At the same time it makes it possible to transmit the new alert information item rapidly to the pilot and to ensure good clarity of the information items so transmitted.

According to an advantageous characteristic, the information item defining the alert condition being updated regularly, the activation of emission of the second acoustic message is effected if the information item defining the alert condition is valid at a moment situated after the end of the step of execution of the interruption decision.

This characteristic makes it possible to undertake emission of the second acoustic message only if the alert condition of which the pilot or the crew members must be informed is still being detected at a moment close to the moment at which emission of the second acoustic message can commence.

Preferably the information defining the alert condition is updated in real time.

This moment close to the moment at which emission of the second acoustic message may commence may advantageously be close to the moment of the end of the second delay step, the duration thereof being longer than the time for updating the information item defining the alert condition.

In a particular embodiment, the interruption of emission of the first message being effected by a system known as interruption system, and emission of the second message being effected by a system known as emission system, the method additionally comprises:

before the step of delay of execution of an interruption decision, a step of transmission, from the emission system to the interruption system, of a command to interrupt the acoustic message, after the first delay step and before the step of activation of emission of a second acoustic message, a step of transmission, from the interruption system to the emission system, of an authorization to emit the acoustic message.

The command to interrupt the acoustic message may be an information item that defines, for the interruption system, a command to interrupt the acoustic message on the basis of a convention.

As an example, it may be an information item representative of a detected alert condition or of a class of alert conditions, this information item defining, for the interruption system, a command to interrupt emission of certain lower-priority acoustic messages in accordance with a predetermined convention for management of acoustic alerts.

It will be noted that the given moment starting from which the step of delay of execution of an interruption decision is effected may be advantageously a moment of transmission of an interruption command or, for example, a moment of reception of such a command by the interruption system.

It will be further noted that the authorization to emit an acoustic message may be an information item that defines, for the emission system, an emission authorization in accordance with a predetermined convention for management of acoustic alerts.

It may be, for example, an information item representative of a detected alert condition or of a class of alert conditions, this information item defining, for the emission system, an authorization to emit certain higher-priority acoustic messages in accordance with a predetermined convention for management of acoustic alerts.

It also will be noted that the duration of the second delay step, or in other words the delay in activation of emission of the second acoustic message, may be counted, for example, from the end of transmission of an authorization to emit an acoustic message.

According to a second aspect, the invention proposes a system for managing an interruption of emission, in an aircraft, of an acoustic message provided with an information item about a state of part of the said aircraft and/or about its environment, the acoustic message being structured into one or more successive acoustic fragments each representative of the said information item, and the system comprising:

means for delaying, starting from a given moment, the execution of a decision to interrupt the emission of the acoustic message until the end of emission of the acoustic fragment that is in the course of emission at the said given moment, and means for executing the said interruption decision.

This system makes it possible to manage the interruption of alert messages in such a way that a fragment carrying sufficient technical information in the course of emission is always emitted until its end.

Preferably, the acoustic message being a first acoustic message, the management system additionally comprises:

means for comparing a priority attribute associated with an information item defining an alert condition received with a current priority threshold associated with the first acoustic message, the said comparison means being capable of modulating how a decision to interrupt the said first acoustic message is made as a function of the comparison, and means for activating emission of a second acoustic message corresponding to the said alert condition.

This system makes it possible to emit a second acoustic message only after a fragment of the first acoustic message has been emitted completely, so as to improve comprehension of the messages by the crew members.

The management system may also be provided with means for determining a priority attribute for an information item representative of a detected alert condition.

Preferably the management system is also provided with means for delaying activation of emission of a second acoustic message.

This delay permits the crew members to distinguish clearly, without any risk of confusion, the end of the first message and the beginning of the new message and thus to be able to interpret the two transmitted alert messages correctly.

Preferably the duration of this delay is between 400 and 600 ms and advantageously is equal to 500 ms. This duration is, for example, counted from execution of the interruption decision.

Advantageously, the information item defining a second alert condition being updated regularly, the system is additionally provided with means for modulating the emission of a second acoustic message by the fact that the information item defining a second alert condition is valid at a moment subsequent to execution of the interruption decision.

It will be noted that the moment subsequent to execution of the interruption decision may be a moment close to the end of the second delay step.

According to a particular embodiment, interruption of emission of the first message being effected by a system known as interruption system, and emission of the second message being effected by a system known as emission system, the management system additionally comprises:

means for transmitting, from the emission system to the interruption system, a command to interrupt the acoustic message, means for transmitting, from the interruption system to the alert system, an authorization to emit the acoustic message.

It also will be noted that the duration of the delay in activation of emission of the second acoustic message may be counted, for example, starting from the end of transmission of an authorization to emit an acoustic message.

According to one characteristic, the management system according to the invention additionally comprises means for determining or analyzing the structure of the said acoustic message.

According to another characteristic, the management system comprises a flight alert system and a system for monitoring the environment of the aircraft.

BRIEF DESCRIPTION OF THE DRAWINGS

Other characteristics and advantages of the invention will become apparent in the light of the non-limitative description presented hereinafter and of the following figures provided by way of illustration.

DESCRIPTION OF THE PREFERRED EMBODIMENTS

Figure 1:
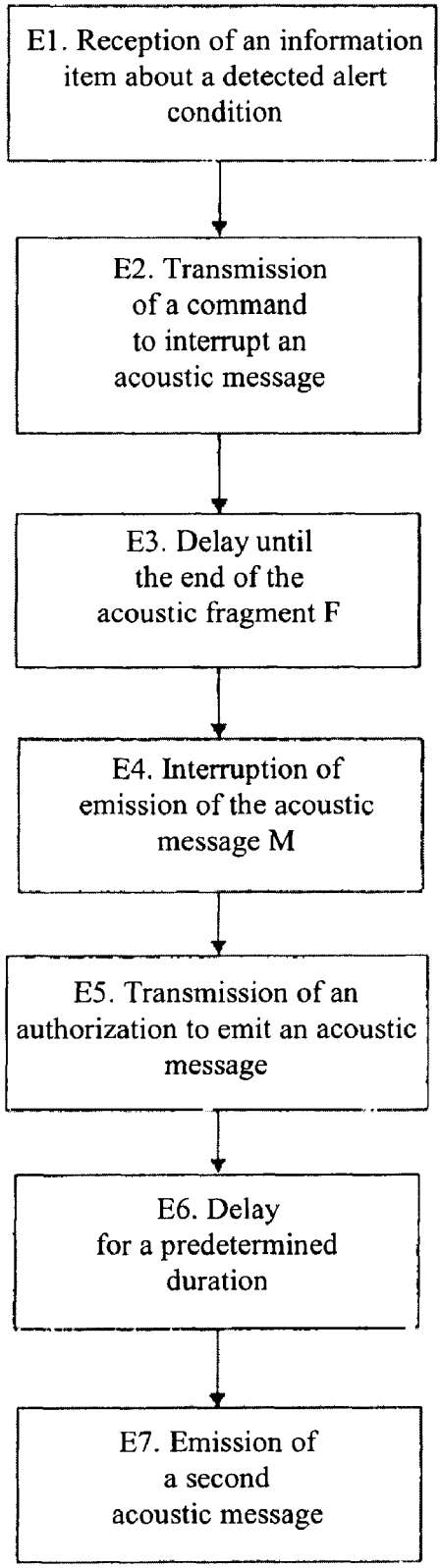
FIG. 1 is a general diagram of an embodiment of a management algorithm according to the invention.

As illustrated in FIG. 1, an example of the method for managing an interruption of an acoustic message begins with a step E1 of reception of an information item about a detected alert condition. Reception takes place in a first system managing the emission of acoustic messages, including an acoustic message associated with the detected alert condition.

The management method is continued with a step E2 of transmission, from the first system to a second system managing the interruption of acoustic messages, of a command to interrupt the acoustic message.

This second system receives the command to interrupt the acoustic message while it is in the process of emitting an acoustic message M structured into successive acoustic fragments (or message portions). More precisely, at the moment at which the second system receives the command to interrupt the acoustic message, it is in the process of emitting the acoustic fragment F.

A decision to interrupt the acoustic message M is then made within the second system.

The method is continued with a step E3 of delaying execution of the interruption decision until the end of the acoustic fragment F. This step is effected in the second system.

The method then comprises a step E4 of interruption of the emission of the acoustic message M, which step also is effected in the second system.

The method is then continued with a step E5 of transmission, from the second system to the first system, of an emission authorization.

Finally, the method is then completed with a step E6 of delay for a predetermined duration in the first system, and by a step E7 of emission of a second acoustic message E7, also in the first system.

According to an alternative embodiment, the first system and the second system are merged. In this case, steps E2 and E5 are not effected, and the acoustic message M and the acoustic fragment F are those in the course of emission at the moment of reception of an information item about an alert condition detected by the first system.

According to another alternative embodiment, the step E5 of transmission of an emission authorization takes place after the step E6 of delay for a predetermined duration, which step is achieved in the second system.

Figure 2:
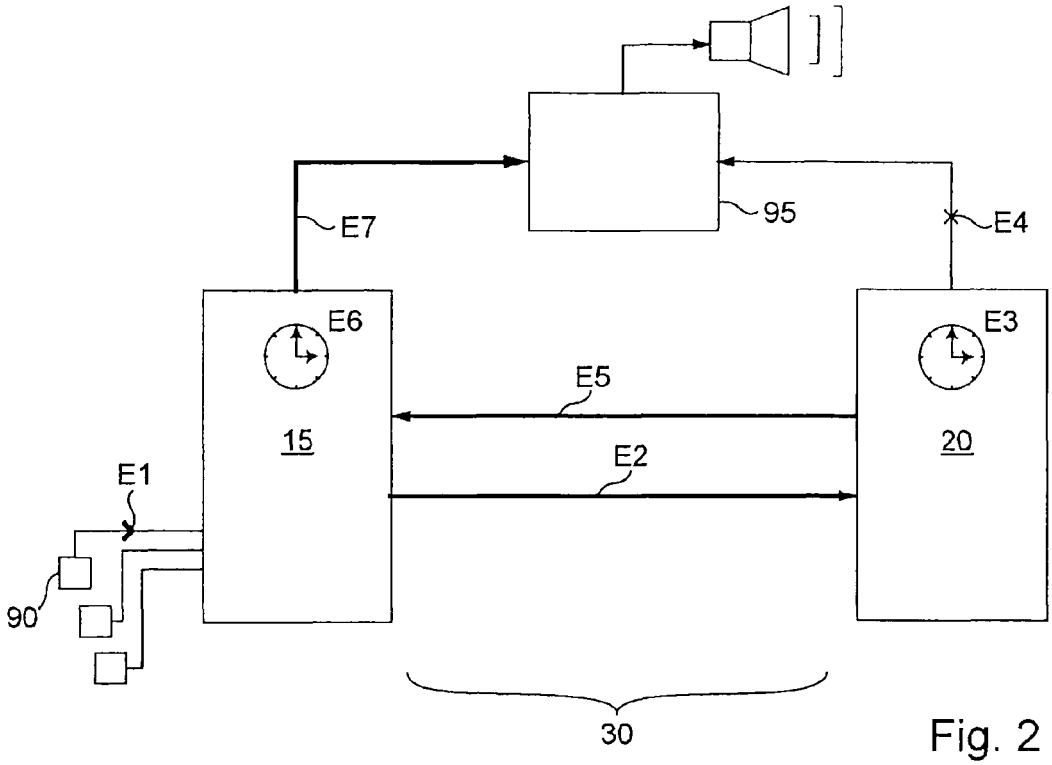
FIGS. 2, 3, 4 and 5 each represent a schematic diagram of one embodiment of a management system according to the invention during execution of four different embodiments of the method according to the invention.

Referring to FIG. 2, a management system includes elements of a flight alert system (FWS) 15 and of an AESS 20. Flight alert system 15 and AESS 20 are constructed with embedded real-time electronics, which detect the states of the aircraft (parts, subassemblies, equipment items, etc.) and of its environment in real time. They are connected to one another and to the other on-board systems by an internal communication network 30 of Ethernet AFDX type.

Still referring to FIG. 2, a monitored system 90 is connected to flight alert system 15. The monitored system is, for example, a fuel gauge, a calculator connected to an engine or a detector connected to a landing gear. Of course, other monitored systems are connected to the AESS and/or to the flight alert system.

In the preferred embodiment, the management system possesses, for each detected alert condition of which the flight alert system or the AESS may be informed, means for determining a priority attribute. These means are implemented, for example, in software form. They are distributed, for example, in flight alert system 15 and AESS 20.

The table presented hereinafter shows, for each alert condition associated with flight alert system 15 and AESS 20, its priority rank. The table is stored in memory in a memory space of the flight alert system, for example, or is duplicated in a memory of the flight alert system and a memory of the AESS. The priority ranks can be determined by a convention that will be explained hereinafter.

The described device also comprises means known as acoustic messages.

Each acoustic message corresponds to all of the alert information items to be emitted in the case that a single alert condition is detected. Examples of acoustic messages are "PULL UP", "HUNDRED ABOVE", "TOO LOW TERRAIN PULL UP" or "WINDSHEAR WINDSHEAR WINDSHEAR".

The acoustic messages therefore constitute a technical prerequisite.

The management system comprises emission means for each of the acoustic messages. These may be implemented in the flight alert system or in the AESS, or may be present in a third system such as an AMU ("Audio Multiplexer Unit"), denoted by 95 in FIG. 1 and having the function of managing acoustic emissions in the cockpit.

The described device is also provided with means for determining a current priority threshold for an acoustic message in the course of emission. These means also are implemented in software form. They are present in both the flight alert system 15 and the AESS 20, or in an alternative are present in only one of the two systems.

In the described embodiment, the current priority threshold for an acoustic message in progress does not change in the course of time, but in another embodiment it could depend on conditions that vary with time in relation to the aircraft and its environment.

More precisely, the priority threshold associated with an acoustic message in the course of emission is identical to the priority attribute associated with the detected alert condition corresponding to the acoustic message.

The described device also comprises comparison means for comparing different priority attributes, especially a priority attribute of an acoustic message in the course of emission and a priority threshold of a detected alert condition. These comparison means are capable of modulating how a decision to interrupt the acoustic message in the course of emission is made, as a function of the comparison. These comparison means are present in both flight alert system 15 and AESS 20, or in an alternative are present in only one of the two systems.

This comparison is undertaken according to the following convention, in relation with the table hereinafter, which is implemented in the management system.

Among themselves, the acoustic messages of AESS 20 have priority ranks indexed from 1 to 19. These ranks are indicated for each message stored in the table. Certain messages of the AESS are seen to attribute the same priority rank, because the conditions for their detection may not exist at the same moment: they are said to be exclusive.

Among themselves, the acoustic messages of flight alert system 15 also have a priority rank, indexed from A to D. The message groups of rank A and D themselves have an internal sub-rank (not described). In the same way as for the messages of the AESS, certain acoustic messages can be seen to attribute the same priority rank, if the conditions for their detection cannot exist at the same moment.

The following rules define the relationship between these different priority ranks:

- the messages of the flight alert system with priority rank A take precedence over all messages of the AESS;
- the messages of the flight alert system with priority rank B take precedence over the messages of the AESS with priority rank 3 to 19, but the messages of the AESS with priority rank 1 or 2 take precedence over the messages of the flight alert system with priority rank B;
- the messages of the flight alert system with priority rank C take precedence over the messages of the AESS with priority rank 8 to 19, but the messages of the AESS with priority rank 1 to 7 take precedence over the messages of the flight alert system with priority rank C;

the messages of the AESS with priority rank 1 to 19 take precedence over the messages of the flight alert system with priority rank D.

Furthermore, the described device comprises elemental acoustic recordings known as digital words. Each digital word is stored in memory in a calculator in the form of a recorded audio file. Examples of digital words are "PULL UP", "WINDSHEAR", "HUNDRED", "ABOVE", "TOO LOW" or "TERRAIN".

In the preferred embodiment, digital words are recorded in read-only memories (ROM) of flight alert system 15 and in read-only memories of AESS 20. Other implementations are possible.

Each acoustic message is a digital word or a combination of several digital words.

In addition, in the described embodiment, the acoustic messages are structured into fragments. Each acoustic message fragment is a digital word or a combination of several digital words, each carrying information that is useful and exploitable by the person who hears it.

Each acoustic message fragment is determined in such a way as to permit the pilot to understand the information that it carries, thus ensuring that he is aware of the detected situation.

Thus the pilot needs to hear not the entire message but only a representative fraction thereof to be warned of the alert situation. It does not take as long to listen to this fraction as it does to the entire message, which allows the pilot to become aware of the significant content of this message within a reduced time. As a result, the management system can rapidly emit another acoustic message warning of another alert condition.

Examples of acoustic message fragments are "PULL UP", indicating to the pilot that the airplane must gain altitude, "WINDSHEAR", announcing shearing winds, "HUNDRED ABOVE", indicating that the airplane is 100 feet above the decision altitude, or "TOO LOW TERRAIN", indicating that the airplane is too low.

The table below presents the list of alert conditions and of acoustic messages of flight alert system (FWS) 15 and of AESS 20, as well as the breakdown of acoustic messages into acoustic fragments.

| Alert condition | System | Priority | Acoustic message and breakdown into acoustic message fragments |
|---|---|---|---|
| Stall | FWS | A | "STALL", "STALL" |
| Windshear reactive | FWS | A | "WINDSHEAR", "WINDSHEAR", "WINDSHEAR" |
| PULL UP (mode 1) | AESS | 1 | "PULL UP" |
| TERRAIN (preface mode 2A) | AESS | 2 | "TERRAIN", "TERRAIN" |
| TERRAIN - PULL UP (mode 2) | AESS | 2 | "PULL UP" |
| V one | FWS | B | "V ONE" |
| TCAS RA | AESS | 3 | "CLIMB", "CLIMB" |
| TCAS RA | AESS | 3 | "CLIMB", "CROSSING CLIMB" (*2) |
| TCAS RA | AESS | 3 | "INCREASE CLIMB", "INCREASE CLIMB" |
| TCAS RA | AESS | 3 | "CLIMB", "CLIMB NOW" (*2) |
| TCAS RA | AESS | 3 | "DESCEND", "DESCEND" |
| TCAS RA | AESS | 3 | "DESCEND", "CROSSING DESCEND" (*2) |
| TCAS RA | AESS | 3 | "INCREASE DESCENT" (*2) |
| TCAS RA | AESS | 3 | "DESCEND", "DESCEND NOW" (*2) |
| TCAS RA | AESS | 3 | "ADJUST VERTICAL SPEED", "ADJUST" |
| TCAS RA | AESS | 3 | "MONITOR VERTICAL SPEED" |
| TCAS RA | AESS | 3 | "MAINTAIN VERTICAL SPEED", "MAINTAIN" |
| TCAS RA | AESS | 3 | "MAINTAIN VERTICAL SPEED", "CROSSING MAINTAIN" |
| TERRAIN - PULL UP (not closure) | AESS | 4 | "TERRAIN AHEAD PULL UP" |
| Obstacle awareness PULL UP | AESS | 5 | "OBSTACLE AHEAD PULL UP" |
| PWS Warning | AESS | 6 | "GO AROUND", "WINDSHEAR AHEAD" |
| PWS Warning | AESS | 6 | "WINDSHEAR AHEAD" (*2) |
| TCAS RA | AESS | 7 | "CLEAR OF CONFLICT" |
| Lower energy | FWS | C | "SPEED", "SPEED", "SPEED" |
| Terrain awareness caution | AESS | 8 | "TERRAIN AHEAD" (*2) |
| Obstacle awareness caution | AESS | 9 | "OBSTACLE AHEAD" (*2) |
| TERRAIN (Caution mode 2) | AESS | 10 | "TERRAIN" |
| TOO LOW TERRAIN (mode 4) | AESS | 11 | "TOO LOW TERRAIN" |
| TOO LOW TERRAIN (caution) | AESS | 12 | "TOO LOW TERRAIN" |
| TOO LOW GEAR (mode 4) | AESS | 13 | "TOO LOW GEAR" |
| TOO LOW FLAP (mode 4) | AESS | 14 | "TOO LOW FLAP" |

-continued

| Alert condition | System | Priority | Acoustic message and breakdown into acoustic message fragments |
|---|---|---|---|
| SINK RATE (mode 1) | AESS | 15 | "SINK RATE" (—) "SINK RATE" |
| DON'T SINK (mode 3) | AESS | 16 | "DON'T SINK" (—) "DON'T SINK" |
| GLIDE SLOPE (mode 5) | AESS | 17 | "GLIDE SLOPE" |
| PWS caution | AESS | 18 | "MONITOR RADAR DISPLAY" |
| TCAS TA | AESS | 19 | "TRAFFIC", "TRAFFIC" |
| DUAL INPUT | FWS | D | "DUAL INPUT" |
| PRIORITY LEFT | FWS | D | "PRIORITY LEFT" |
| PRIORITY RIGHT | FWS | D | "PRIORITY RIGHT" |
| PITCH | FWS | D | "PITCH", "PITCH" |
| MINIMUM | FWS | D | "MINIMUM" |
| TWENTY RETARD | FWS | D | "TWENTY RETARD" |
| TEN RETARD | FWS | D | "TEN RETARD" |
| RETARD (repeated continuously) | FWS | D | "RETARD" (*n) |
| SINGLE RETARD | FWS | D | "RETARD" |
| HUNDRED ABOVE | FWS | D | "HUNDRED ABOVE" |
| PLUS HUNDRED | FWS | D | "PLUS HUNDRED" |
| 5 | FWS | D | "FIVE" |
| 10 | FWS | D | "TEN" |
| 20 | FWS | D | "TWENTY" |
| 30 | FWS | D | "THIRTY" |
| 40 | FWS | D | "FORTY" |
| 50 | FWS | D | "FIFTY" |
| 100 | FWS | D | "ONE HUNDRED" |
| 200 | FWS | D | "TWO HUNDRED" |
| 300 | FWS | D | "THREE HUNDRED" |
| 400 | FWS | D | "FOUR HUNDRED" |
| 500 | FWS | D | "FIVE HUNDRED" |
| 1000 | FWS | D | "ONE THOUSAND" |
| 2000 | FWS | D | "TWO THOUSAND" |
| 2500 | FWS | D | "TWO THOUSAND FIVE HUNDRED" |
| 25 HUNDRED | FWS | D | "TWENTY FIVE HUNDRED" |

In the described embodiment, the management system is provided with means, in the form of a software application, that have the function of interrupting an acoustic message in the course of emission, specifically between two acoustic message fragments.

More precisely, these means comprise, on the one hand, means for delaying the execution of a decision to interrupt the emission of an acoustic message, starting from a given moment until the end of emission of the acoustic fragment that is in the course of emission at the said given moment, and, on the other hand, means for executing a decision to interrupt an acoustic message.

These means are present in both flight alert system FWS 15 and AESS 20. Alternatively, they may be present in AMU 95 or in another avionic system.

The management system also comprises means, in the form of a software application, that have the function of retarding activation of emission of an acoustic message until no emission of an acoustic message is in progress.

Furthermore, the management comprises delay means, in the form of software, that have the function of introducing a silence of 500 ms between the end of emission of an acoustic message fragment originating from a first acoustic message and the beginning of emission of a second acoustic message fragment originating from a second acoustic message.

These means therefore make it possible to achieve a step of delay of the emission of a second acoustic message. They are present in both flight alert system 15 and AESS 20.

The explanation of the invention will be continued with the non-limitative description of four scenarios of use of the described device.

In a first scenario of use of the described method, as represented in FIG. 2, an acoustic message of AESS 20 is in the course of emission when an alert condition of flight alert system 15 is detected. The alert condition detected by flight alert system 15 has higher priority than the alert message in the course of emission by AESS 20.

At the moment t0, AESS 20 is in the process of emitting the acoustic message "DESCEND CROSSING DESCEND; DESCEND CROSSING DESCEND", corresponding to a TCAS RA alert (for "Traffic Collision Avoidance System Resolution Advisory" or TCAS resolution advice).

Starting from a moment t1, flight alert system 15 detects the alert condition "Stall" (step E1, FIG. 1), which indicates a stall, and which in an airplane is an alert condition of very high degree of priority.

Starting from a moment t2, AESS 20 receives the information item from flight alert system 15, indicating to it that it is no longer authorized to emit an acoustic message regardless of the priority level thereof. The moment t2 is separated from the moment t1 by a duration corresponding to at most one calculation cycle of flight alert system 15, plus a latency time of network 30 connecting flight alert system 15 to AESS 20.

Starting from a moment t3, this registers the information item according to which it has received, from flight alert system 15, a command to interrupt acoustic messages regardless of their priority level (end of step E2, FIG. 2).

The moment t3 follows the moment t2 by at most a maximal latency time of AESS 20. At this moment t3, the AESS is in the process of emitting the first word "DESCEND" of the acoustic message.

AESS 20 then effects a step of delay until the end of emission of the word "DESCEND" that corresponds to the end of the first acoustic fragment of the message "DESCEND CROSSING DESCEND; DESCEND CROSSING DESCEND" and therefore the first moment for which an interruption is authorized.

AESS 20 therefore continues emission of the acoustic alert until the end of the indivisible fragment "DESCEND", which occurs at a moment t6 (step E3, FIG. 2, delay steps being represented by a clock symbol).

Starting from this moment t6, AESS 20 ceases all emission, thus executing the previously received interruption command (step E4, FIG. 2).

At a later moment t7, AESS 20 emits an information item intended for flight alert system 15, according to which it is no longer emitting any acoustic message (step E5, FIG. 2).

The delay between t6 and t7 is at most equal to the maximal latency time of the AESS.

At a later moment t8, flight alert system 15 registers the information item originating from AESS 20 and according to which this is no longer emitting any acoustic message (end of step E5).

The moment t8 follows the moment t7 by a delay at most equal to a latency time of the network at the output of the AESS, plus a time for acquisition and processing of the information item by the flight alert system, and a time for calculation by the flight alert system.

Starting from that moment, flight alert system 15 proceeds to a delay step of, for example, 500 ms (step E6, FIG. 2). At the end of this step, it verifies that the alert conditions "Stall" are still being detected.

Starting from a moment t9, flight alert system 15 emits the acoustic message "STALL STALL" (step E7, FIG. 2).

In this scenario, the delay between detection of the new alert condition by the flight alert system (at the moment t1) and the emission of the acoustic message "STALL STALL" by the flight alert system (at the moment t9) is at most 1722 ms. This delay corresponds to the duration of the message "DESCEND", to which there are added the latency time of the AESS, the delay time of the network, the time for processing of the data by the flight alert system, the time for calculation by the flight alert system and a delay of 500 ms.

A good compromise is therefore obtained between the quickness of emission of the second acoustic message and the complete emission of an intelligible fragment of the first acoustic message.

Figure 3:
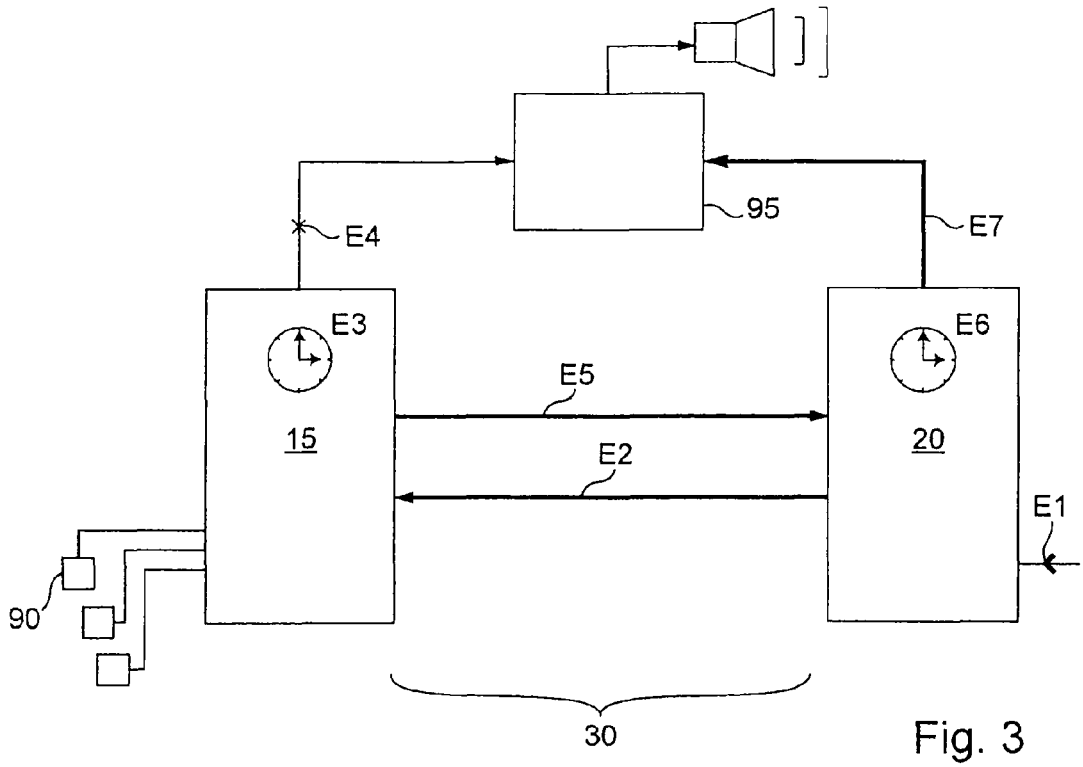

In a second scenario, illustrated in FIG. 3, a low-priority alert is in the course of emission by the flight alert system when an alert is detected by the AESS.

At the moment t0, the flight alert system is in the process of emitting an automatic altitude announcement "PITCH", the content of the associated acoustic message being "PITCH PITCH".

At the moment t1, the AESS detects the alert condition "PWS Warning" (for "Predictive Windshear warning"), the associated acoustic message being "WINDSHEAR AHEAD, WINDSHEAR AHEAD", indicating that shearing winds are detected ahead of the airplane (step E1, FIG. 3).

At the moment t2, AESS 20 sends, to flight alert system 15, an emission authorization request having a priority attribute determined by means for determining the priority attribute (start of step E2).

At the moment t3, the flight alert system registers the request of the AESS and analyzes it as being a command to interrupt the acoustic message in the course of emission (end of step E2, FIG. 3), the priority rank of the alert "PWS Warning" being higher than that of the alert "PITCH PITCH".

The flight alert system makes the decision to interrupt the acoustic message "PITCH PITCH" at the end of the indivisible acoustic fragment in the course of emission at the moment t3, or in other words the first "PITCH" in the described scenario.

Starting from the moment t3, the flight alert system therefore waits for the end of the message "PITCH", in this way proceeding to a delay step (step E3, FIG. 3). Emission of the acoustic fragment "PITCH" is completed at a moment t4, the flight alert system therefore having executed the command to interrupt the acoustic message (step E4, FIG. 3).

At a moment t5, the flight alert system transmits, to the AESS, an information item indicating that it authorizes it to emit an acoustic message (start of step E5, FIG. 3).

At a later moment t6, the AESS registers this information item (end of step 5, FIG. 3). At that moment, the AESS proceeds to a delay step of, for example, 500 ms (step E6, FIG. 3).

At the end of this delay step, AESS 20 verifies that the alert condition "PWS Warning" is still being detected, and in this example it observes that such is indeed the case.

Starting from a subsequent moment t7, the AESS emits the acoustic message "WINDSHEAR" (step E7, FIG. 3).

Figure 4:
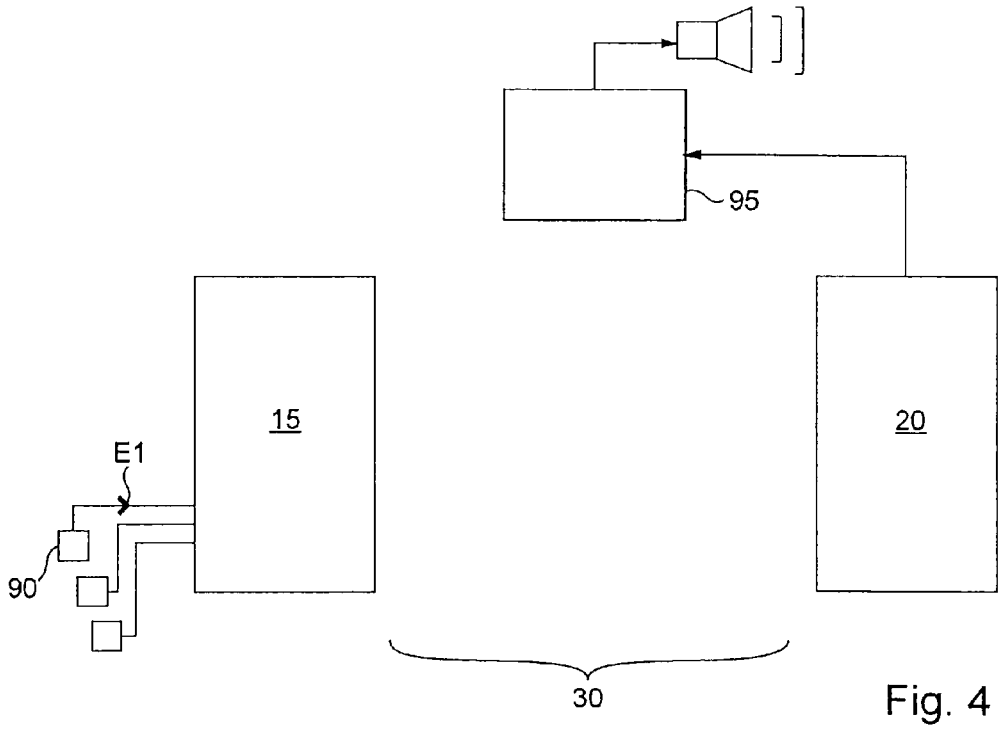

In a third scenario, represented in FIG. 4, the flight alert system detects a condition of emission of an automatic altitude announcement while the AESS is in the process of emitting the acoustic message "TOO LOW FLAP", corresponding to the alert condition "TOO LOW FLAP (mode 4)".

At the moment to, AESS 20 is in the process of emitting the alert message "TOO LOW FLAP".

At a subsequent moment t1, flight alert system 15 receives an information item representative of an alert condition (step E1, FIG. 4). This relates to an automatic altitude announcement "500", the associated acoustic message being "FIVE HUNDRED", indicating that the airplane is situated 500 feet above the ground.

Since the automatic altitude announcement "500" has lower priority than the acoustic message "TOO LOW FLAP", AESS 20 continues to emit the acoustic message "TOO LOW FLAP" until the end of detection of the alert condition "TOO LOW FLAP mode 4". During this time, flight alert system 15 does not emit the acoustic message for the automatic altitude announcement.

At the moment t4, the conditions of the automatic altitude announcement ("500") previously detected by the flight alert system since the moment t1 cease. At this moment t4, AESS 20 has not yet completed emitting the acoustic message "TOO LOW FLAP".

At a subsequent moment t5, flight alert system 15 is informed that the alert condition "TOO LOW FLAP mode 4" is no longer being detected. It completes emission of the acoustic message "TOO LOW FLAP". Thereafter it does not emit any acoustic message, in particular not the acoustic message "FIVE HUNDRED", because the conditions of this automatic altitude announcement are no longer being detected.

Figure 5:
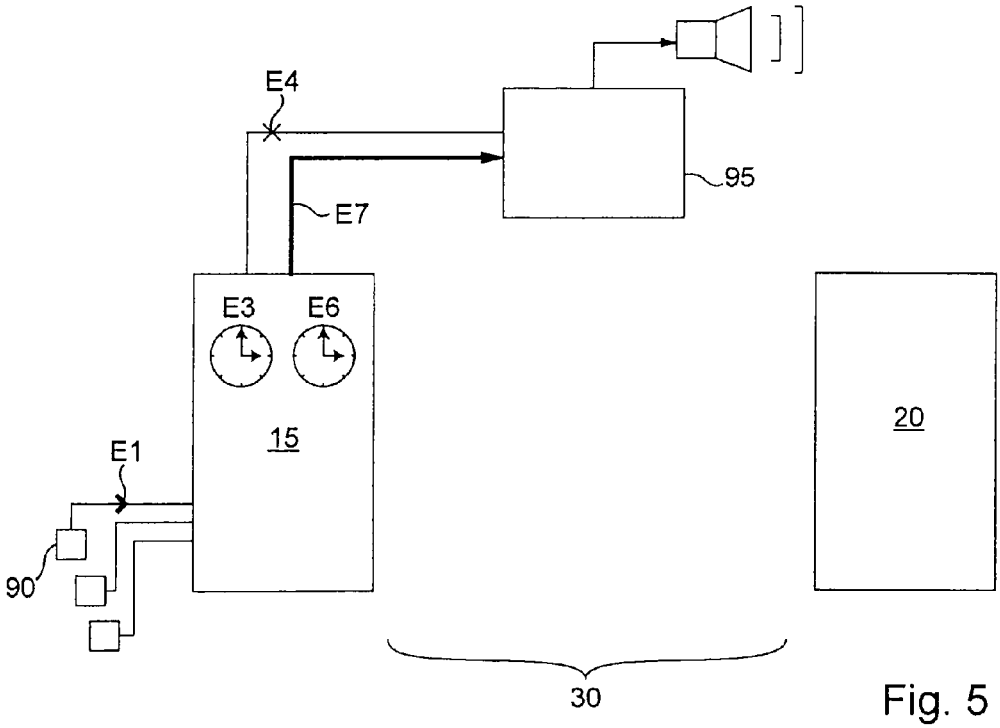

In a fourth scenario, represented in FIG. 5, the flight alert system is in the course of emission of an alert of low priority rank, such as an automatic altitude announcement "WINDSHEAR".

A monitored system having detected an alert condition, such as an alert condition "STALL", it transmits an information item to flight alert system 15, informing it of the detection of this condition (step E1, FIG. 5).

The flight alert system determines the priority level of the detected alert condition. The alert condition "STALL" takes precedence over the alert condition "WINDSHEAR". Using means for comparison of priority attributes, the flight alert system then makes a decision to interrupt emission of the automatic altitude announcement in the course of emission.

The flight alert system then effects a delay step until the end of the acoustic message fragment in the course of emission (step E3, FIG. 5), after which it interrupts emission of the first acoustic message (step E4, FIG. 5).

It also effects a delay step of 500 ms (step E6, FIG. 5), verifies that the previously detected alert condition is still being detected by system 90 and activates emission of the new acoustic message (step E7, FIG. 5).

By virtue of this method, the pilot's understanding of messages emitted by the alert system is enhanced.

In general, the time for data processing by the calculators of network 30 has not been taken into account in the description of these scenarios. This time is indeed negligible compared with the overall latency of the network.

The invention claimed is:

1. A method for managing an interruption of emission of an acoustic message produced in an aircraft, the method comprising:

having available the acoustic message that includes an information item about a state of part of the aircraft and/or environment of the aircraft and that is structured into one or more successive acoustic fragments so that each acoustic fragment is representative of the information item;

delaying, at a moment when a decision to interrupt the emission of the acoustic message is registered, execution of the decision to interrupt the emission of the acoustic message until emission of an acoustic fragment of the acoustic message that is currently being emitted is completed; and executing, by a controller, the decision to interrupt the emission of the acoustic message, thus interrupting the acoustic message that is currently being emitted.

2. The method according to claim 1, wherein the acoustic message is a first acoustic message, and the decision to interrupt the first acoustic message is made as a function of reception of an information item defining an alert condition, the method additionally comprises, after the step of executing the interruption decision, activating emission of a second acoustic message corresponding to the alert condition.

3. The method according to claim 2, wherein between the step of executing the interruption decision and the step of activating emission of the second acoustic message, delaying activation of emission of the second acoustic message.

4. The method according to claim 2 or 3, wherein the information item defining an alert condition is updated regularly, the activation of emission of the second acoustic message is effected if the information item defining an alert condition is valid at a moment situated after the end of the step of executing the interruption decision.

5. The method according to claim 2, wherein the interruption of emission of the first message is effected by a system known as an interruption system, and emission of the second message is effected by a system known as an emission system, the method additionally comprises:

before the step of delaying execution of the interruption decision, transmitting, from the emission system to the interruption system, a command to interrupt the acoustic message, and after the delaying step and before the step of activating emission of the second acoustic message, transmitting from the interruption system to the emission system, an authorization to emit the acoustic message.

6. A system for managing an interruption of emission of an acoustic message produced in an aircraft an, the system comprising:

the acoustic message that includes an information item about a state of part of the aircraft and/or environment of the aircraft and that is structured into one or more successive acoustic fragments so that each acoustic fragment is representative of the information item; and a controller configured to delay at a moment when a decision to interrupt the emission of the acoustic message is registered, execution of the decision to interrupt the emission of the acoustic message until emission of an acoustic fragment of the acoustic message that is currently being emitted is completed, and execute the decision to interrupt the emission of the acoustic message, thus interrupting the acoustic message that is currently being emitted.

7. The system according to claim 6, wherein the acoustic message is a first acoustic message, the management system additionally comprises:

means for comparing a priority attribute associated with an information item defining an alert condition with a current priority threshold associated with the first acoustic message, the comparison means being capable of modulating how a decision to interrupt the first acoustic message is made, and means for activating emission of a second acoustic message corresponding to the alert condition.

8. The system according to claim 7, further comprising:

means for delaying activation of emission of the second acoustic message.

9. The system according to claim 7 or 8, wherein the information item defining an alert condition is updated regularly, the system is additionally provided with means for modulating the emission of a second acoustic message by the fact that the information item defining an alert condition is valid at a moment subsequent to execution of the interruption decision.

10. The system according to claim 7, wherein interruption of emission of the first message is effected by a system known as an interruption system, and emission of the second message is effected by a system known as an emission system, the management system additionally comprises:

means for transmitting, from the emission system to the interruption system, a command to interrupt the acoustic message, and means for transmitting, from the interruption system to the alert system, an authorization to emit the acoustic message.

* * * * *